US006079400A

United States Patent [19]

Tomat Dany

[11] Patent Number: 6,079,400

[45] Date of Patent: Jun. 27, 2000

[54] PORTABLE CAMP KITCHEN

[76] Inventor: Severino Tomat Dany, Via Leonardo Bianchi, 6-00168 Rome, Italy

[21] Appl. No.: 09/091,671

[22] PCT Filed: Dec. 18, 1996

[86] PCT No.: PCT/IT96/00256

§ 371 Date: Jun. 18, 1998

§ 102(e) Date: Jun. 18, 1998

[87] PCT Pub. No.: WO97/22836

PCT Pub. Date: Jun. 26, 1997

[30] Foreign Application Priority Data

Dec. 18, 1995 [IT] Italy ..... RM9500268 U

[51] Int. Cl.[7] ..... F24C 15/10

[52] U.S. Cl. ..... 126/37 B; 126/39 B; 126/37 R

[58] Field of Search ..... 126/37 R, 37 B, 126/39 B

[56] References Cited

U.S. PATENT DOCUMENTS

| | | | |
|---|---|---|---|
| 3,199,503 | 8/1965 | Hanson . | |
| 3,289,664 | 12/1966 | Hewitt | 126/37 R |
| 3,631,235 | 12/1971 | Oderman | 362/133 |
| 3,915,529 | 10/1975 | Bernier | 126/37 B |
| 5,711,209 | 1/1998 | Guines | 126/41 R |
| 5,813,394 | 9/1998 | Clifford | 126/41 R |

FOREIGN PATENT DOCUMENTS

| | | | |
|---|---|---|---|
| 630 354 | 5/1936 | Germany | 126/37 R |
| 559 768 | 3/1944 | United Kingdom . | |
| 2 124 894 | 2/1984 | United Kingdom . | |
| 2 284 905 | 6/1995 | United Kingdom . | |

*Primary Examiner*—Carroll Dority
*Attorney, Agent, or Firm*—Browdy and Neimark

[57] ABSTRACT

A portable camp kitchen comprising a cooker unit (2) with at least one burner (3), a container member (1) adapted to contain said cooker unit (2) integrally with the latter, support means 916) rotatably mounted at ground level on said kitchen, handle means (18), container (5,10) means, lighting means (4), power supply means, movable covering means (8,9,12,13).

16 Claims, 2 Drawing Sheets

PORTABLE CAMP KITCHEN

DESCRIPTION

1. Field of the invention

The present invention relates to a portable camp kitchen, and more specifically to a modular portable camp kitchen for open-air activities such as camping, picnics, first aid camps, etc.

2. Related art

Portable camp kitchens for use in the open are already known from the state of the art. They comprise a cooker unit, generally made of enamelled iron, which holds a pair of burners, and a cover on the top. The cooker unit is usually positioned on top of another base unit, generally made of metal, which holds at the inside thereof kitchen utensils and the gas bottle for the fuel gas supplying to the burners.

The abovementioned camp kitchen is therefore constituted of two separate members, which are only connected during their function. This kind of camp kitchen is known from GB-A-2124894.

This causes the problem that in order to use the cooker unit it has to be placed on the top of another structure, and the fact that it is necessary to have another structure as well as the cooker unit in order to provide a complete camp kitchen with kitchen utensils and with a fuel supply for the burners.

An additional problem is caused by the fact that the kitchen as a whole is not easy to transport, as it is made up of a number of components that must be disconnected before transport and then re-connected again before they can be used.

Another problem relates to the utensils inside the abovementioned base unit, which must be removed before transport and which must therefore be packed into another container during transport and then replaced inside the base unit when finally mounted.

All the above increases the difficulties for the person using the kitchen, as well as increasing the time required to assemble the kitchen itself.

SUMMARY OF THE INVENTION

Object of the present invention is therefore to solve the abovementioned problems by providing a portable camp kitchen having a cooker unit integral mounted on a container member wherein the kitchen utensils and the power supply for the cooker unit are also contained, the whole forming a single unit to enable it to be transported without the need to disassemble the components before they are moved.

The present invention provides a portable camp kitchen, comprising:

a cooker unit with at least one burner;

a container member apted to contain said cooker unit integrally with the latter;

support means rotatably mounted at ground level on said kitchen;

handle means;

container means;

lighting means;

power supply means; and movable covering means, characterised in that said movable covering means comprises:

a first pair of flat doors pivotally mounted on the top of said cooker unit and apted to move from a closed position, wherein they totally cover said cooker unit, to an open position wherein they form two worktops; and a second pair of vertical flat doors pivotally mounted at the front of said container member and apted to move from a closed position, wherein they frontally close said container member to a fully open position wherein they provide a support for the abovementioned first pair of flat doors.

Advantageously the portable camp kitchen of the present invention is easy to transport, simple to position and requires little assembly.

Another advantage is that the portable camp kitchen of the present invention is apted to contain everything necessary for cooking in a single unit, and it is easy to manufacture and requires an extremely low maintenance, is reliable, robust and low in cost.

The present invention will now be illustrated in further detail by the description of a preferred embodiment thereof, given merely as a non-limiting example, and with reference to the enclosed drawings.

DETAILED DESCRIPTION OF THE PREFERRED EMBODIMENT

Figure 1:
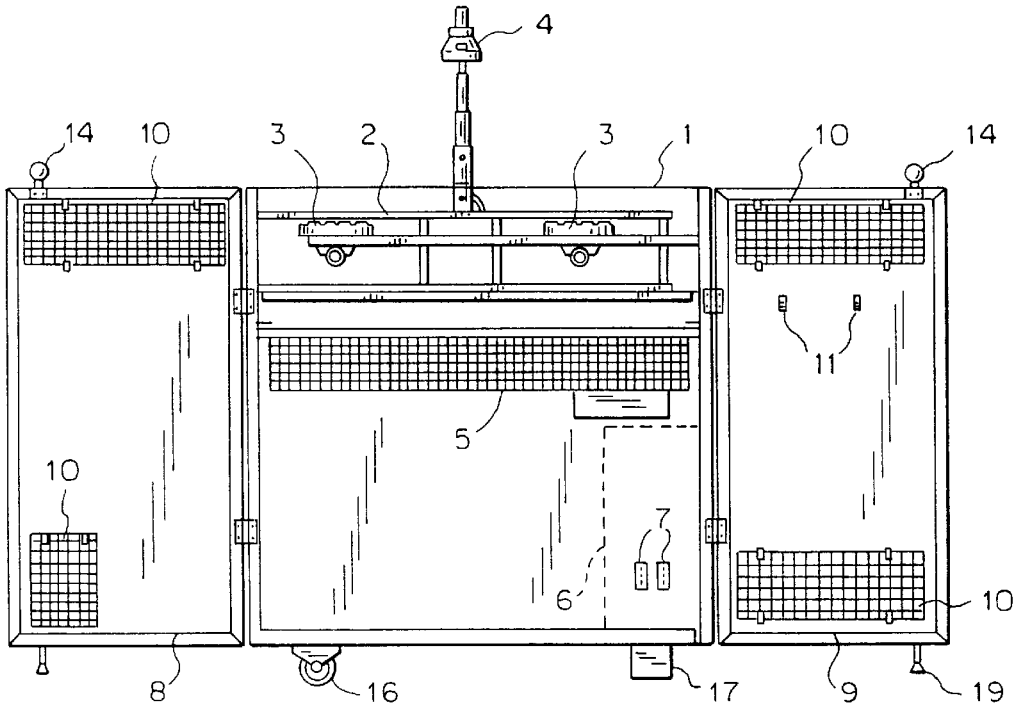
FIG. 1 is a front view of the camp kitchen according to the present invention.

Referring to FIG. 1, a front elevation view of the portable camp kitchen according to the present invention is shown.

The kitchen has a unit comprising a body member 1, shaped substantially as a parallelepiped, on the top and inside thereof is arranged a cooker unit 2 which has a pair of burners 3 and respective control accessories for adjustment of the flame (not shown in the figure).

Also, a telescopic lamp 4 is pivotally mounted on top of the body member 1, hinged at the base thereof in such a way that it can be turned by 90° and stored inside the camp kitchen during transport.

Below the cooker unit 2 a sliding basket 5 is arranged, for the storing of a plurality of kitchen utensils and equipment. On the bottom of said body member 1 there is provided in a removable manner a gas bottle 6 (indicated by a dotted line in the figure) to supply fuel gas the burners 3.

Furthermore, behind the fuel gas bottle 6, a pair of sockets 7 are provided on the rear wall of said body member 1, to supply electric power coming from the outside to the lamp 4 and optionally to electric accessories installed therein.

On the front the body member 1 has a pair of flat doors 8 and 9, respectively, hinged to the latter in such a way that they can rotate by 180° from a closed position to a fully open position. On the inner surface of the doors 8 a plurality of baskets 10, with a variety of shapes and sizes are fixed to the doors in a removable manner, in order that they can be removed when required.

Furthermore, when required, it is possible to provide hooks 11 (two of which are shown in the figure) or connectors for utensils, accessories, etc. on said doors 8 and 9, respectively.

The top of the body member 1 is provided with a second pair of flat doors 12 and 13, respectively, (not in the figure and shown further), hinged to the body member 1 so that they can rotate 180° from a closed position to a fully open position. When the flat doors 12 and 13 are closed, they are arranged over the cooker unit 2, and when they are fully open they fall to the two opposite sides of the cooker unit 2, creating two worktops, thus improving working comfort.

However, in both cases the doors 12 and 13 are kept positionally fixed by means of knobs 14 which screw onto respective mother screws 15 (See FIG. 4) the latter being provided on the top edge of the doors 8 and 9. Said screw of knobs 14 passes through respective bores 21 in said mother screw 15 on the doors 12 and 13 when doors 8 and 9 are open, said bores and said mother screws coinciding when both the pair of doors 8, 9 and 12, 13 are respectively fully closed or fully open.

The whole thus assembled rests on the ground on a pair of steering wheels 16 and a pair of fixed supports 17, to facilitate transport of the unit as a whole.

Furthermore, a pivotable handle 18 (See FIG. 3) is provided to facilitate transport.

If required, it is also possible to connect, by screwing, a pair of rod-shaped ground support elements 19 with respective knobs 20 (See FIGS. 2–4) to the flat doors 12 and 13, respectively, so that to provide the latter a support on the ground when they are fully open.

Figure 2:
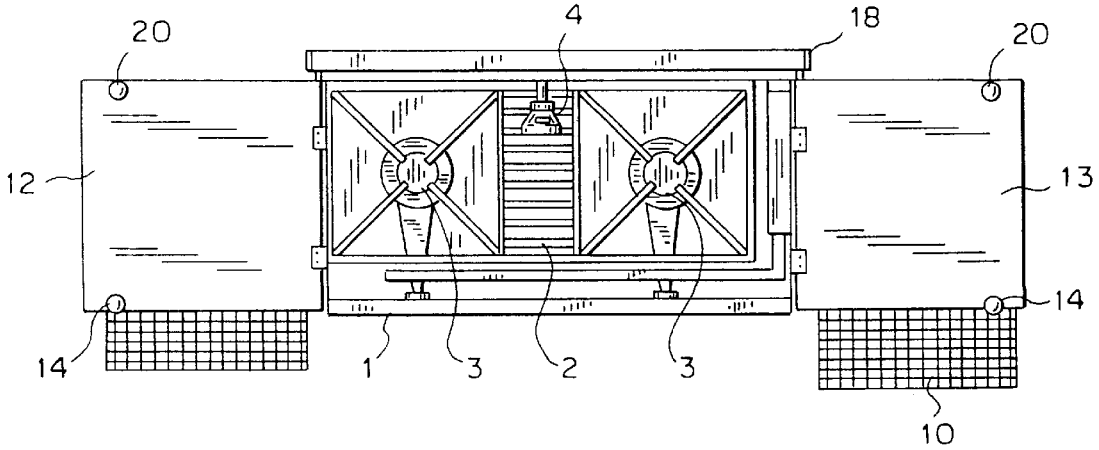
FIG. 2 is a top plan view of the camp kitchen of FIG. 1.

With reference now to FIG. 2, a top plan view of the camp kitchen of FIG. 1 is shown. This figure illustrates more clearly the arrangement of the flat doors 12 and 13 when fully open and the position of the handle 18 when the doors are fully open.

Figure 3:
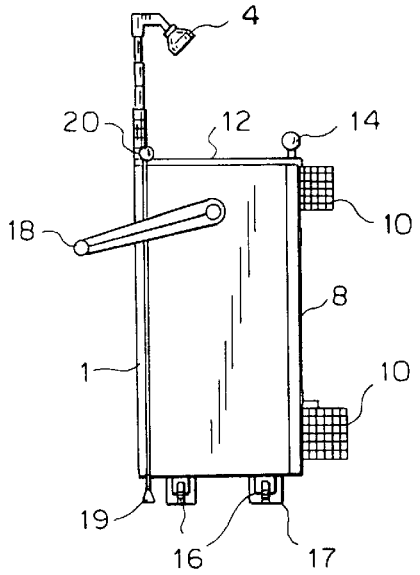
FIG. 3 is a side view of the camp kitchen of FIG. 1.

With reference now to FIG. 3, it shows a side elevation of the camp kitchen. As shown, the handle 18 is rotationally connected at the two opposite sides of the body member 1, so that the camp kitchen can easily be grasped for transport.

Figure 4:
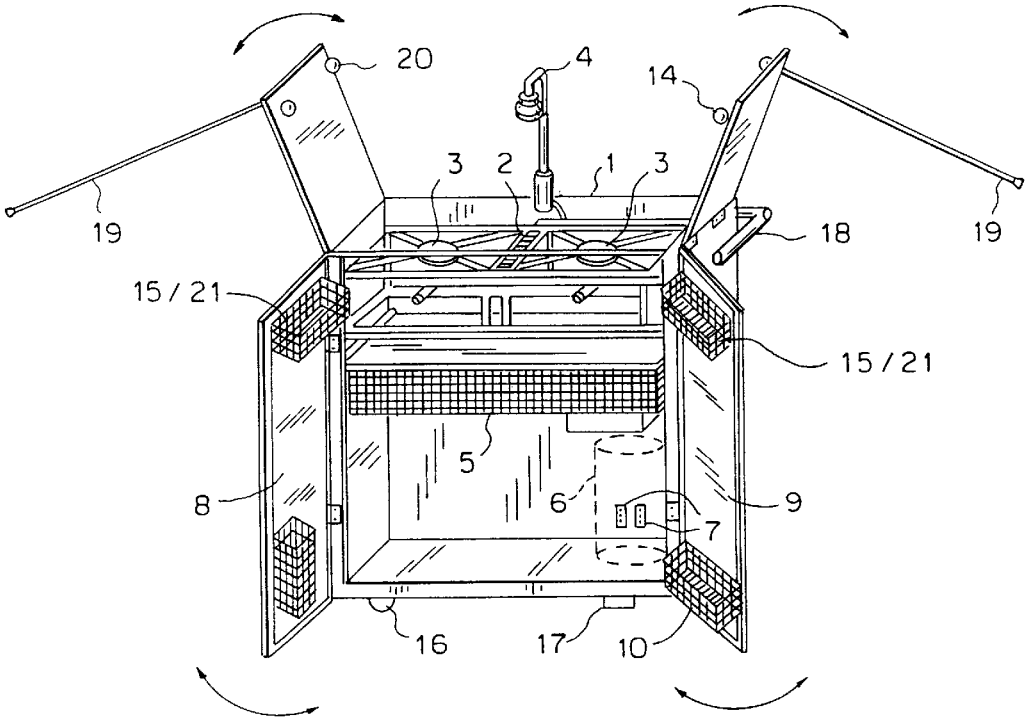
FIG. 4 is a perspective view showing the portable camp kitchen of FIG. 1.

Referring now to FIG. 4, it shows a front view of the camp kitchen, in which said first and second pairs of flat doors are in an intermediate position.

As is more clear, the arrangement of the mother screws 15 on the top edges of the flat doors 8 and 9, allows said doors 8 and 9 to be connected in a fixed manner to the doors 12 and 13, respectively when fully open and when fully closed, i.e. during transportation or during its use.

The present invention is not limited to the embodiment described, but comprises any variation thereof within the scope of the appended claims.

What is claimed is:

1. A portable camp kitchen, comprising:

a cooker unit (2) with at least one burner (3);

a container member (1) adapted to contain said cooker unit (2) integrally with the latter;

a support means (16) rotatably mounted at ground level on said kitchen;

handle means (18);

container means (10)

lighting means (4);

power supply means; and movable covering means (8,9,12,13)

characterized in that said movable covering means comprises:

a first pair of flat doors 912,13) rotatably mounted on the top of said cooker unit (2) and adapted to move from a closed position, wherein they totally cover said cooker unit (2), to an open position wherein they form a two work-tops; and a second pair for vertical flat doors (8,9) rotatably mounted at the front of said container member (1) and adapted to move from a closed position, wherein they frontally close said member (1) to a fully open position wherein they provide a support for the abovementioned first pair of flat doors (12,13);

wherein said handle means are a handrail (18) rotatably mounted on said containing member (1) and extending from one side to the opposite side of said containing member.

2. A portable camp kitchen according to claim 1, wherein said support means rotatably mounted at ground level are steering wheels (16) rotatably connected to said container member (1) at the bottom thereof.

3. A portable camp kitchen according to claim 1, wherein said container means comprises a plurality of removable baskets (5,10) adapted to contain any kind of kitchen utensils and arranged inside said container member (1).

4. A portable camp kitchen according to claim 1, wherein said lighting means comprises a telescopic lamp (4) rotatably mounted on the top of the cooker unit (2) and hinged to said container member (1).

5. A portable camp kitchen according to claim 1, wherein said power supply means comprises a fuel gas bottle eventually removably positioned at the inside of said container member (1).

6. A portable camp kitchen according to claim 1, wherein said power supply means comprises a source of electric power eventually removably positioned inside said container member.

7. A portable camp kitchen according to claim 3, wherein said second pair of vertical doors (8,9) provide a support for said removable baskets (10).

8. A portable camp kitchen, comprising:

a cooker unit (2) with at least one burner (3);

a container member (1) adapted to contain said cooker unit (2) integrally with the latter;

support means (16) rotatably mounted at ground level on said kitchen;

a handle means (18);

container means (10);

lighting means (4);

power supply means (4);

movable covering means (8,9,12,13), characterized in that said movable covering means comprises:

a first pair of flat doors (12,13) rotatably mounted on the top of said cooker unit (2) and adapted to move from a closed position, wherein they totally cover said cooker unit (2), to an open position wherein they form two work-tops; and a second pair of vertical flat doors (8,9) rotatably mounted at the front of said container member (1) and adapted to move from a closed position, wherein they frontally close said container member (1) to a fully open position wherein the provide a support for the abovementioned first pair of flat doors (12, 13);

first positioning means on said first pair of flat doors and second positioning means on said second pair of vertical doors for engagement together and fixing said first pair of vertical doors when either in said fully open position or in said fully closed position.

9. The portable camp kitchen according to claim 8, wherein said first positioning means comprise screw knobs and said second position means comprise bores and mother screws.

10. A portable camp kitchen according to claim 8, wherein said support means rotatably mounted at ground level are steering wheels (16) rotatably connected to said container member (1) at the bottom thereof.

11. A portable camp kitchen according to claim 8, wherein said handle means is a handrail (18) rotatably mounted on said containing member (1) and extending form one side to the opposite side of said containing member.

12. A portable camp kitchen according to claim 8, wherein said container means comprises a plurality of removable baskets (5,10) adapted to contain any kind of kitchen utensils and arranged inside said container member (1).

13. A portable camp kitchen according to claim 8, wherein said lighting means comprises a telescopic lamp (4) pivotally mounted on the top of the cooker unit (20 and hinged to said container member (1).

14. A portable camp kitchen according to claim 8, wherein said power supply means comprises a fuel gas bottle eventually removably positioned inside container member.

15. A portable camp kitchen according to claim 8, wherein said power supply means comprises a source of electric power eventually removably positioned inside said container member.

16. A portable camp kitchen according to claim 12, wherein said second pair of vertical doors (8,9) provide a support for said removable baskets (10).

* * * * *